US007455202B2

(12) United States Patent
Shimura

(10) Patent No.: US 7,455,202 B2
(45) Date of Patent: Nov. 25, 2008

(54) HANGER BODY FOR CLOTHING AND HANGER FURNISHED WITH THE HANGER BODY

(76) Inventor: Masahiro Shimura, Kyoei-Building 2F, 22-11, Sakurashinmachi 2-Chome, Setagaya-ku Tokyo 154-0015 (JP)

( * ) Notice: Subject to any disclaimer, the term of this patent is extended or adjusted under 35 U.S.C. 154(b) by 0 days.

(21) Appl. No.: 11/789,007

(22) Filed: Apr. 23, 2007

(65) Prior Publication Data

US 2007/0246491 A1 Oct. 25, 2007

(30) Foreign Application Priority Data

Apr. 21, 2006 (JP) ..... 2006-118576

(51) Int. Cl.
*A41D 27/22* (2006.01)

(52) U.S. Cl. ..... 223/89; 223/88; 223/92; 223/94

(58) Field of Classification Search ..... 223/85, 223/88, 89, 92, 94; 211/85.3, 113
See application file for complete search history.

(56) References Cited

U.S. PATENT DOCUMENTS 2,420,116 A * 5/1947 Walters ..... 223/89
2,496,561 A * 2/1950 Saunders ..... 223/94
2,588,235 A * 3/1952 Herrick ..... 223/90
4,004,721 A * 1/1977 Ross ..... 223/89
5,102,019 A * 4/1992 Lam ..... 223/94
5,456,391 A * 10/1995 Chang ..... 223/94
5,511,701 A * 4/1996 Lam ..... 223/85
5,664,710 A * 9/1997 Lam ..... 223/94
5,826,759 A * 10/1998 Ohsugi ..... 223/85
6,179,174 B1 * 1/2001 Kandl ..... 223/94
6,644,520 B2 * 11/2003 Lam ..... 223/94

FOREIGN PATENT DOCUMENTS

JP 2002-330857 A 11/2002

* cited by examiner

*Primary Examiner*—Gary L Welch
*Assistant Examiner*—Nathan E Durham
(74) *Attorney, Agent, or Firm*—Hoffmann & Baron, LLP

(57) ABSTRACT

A hanger body 10 is provided with a body section 20, a pair of stick type extension members 30, which is embedded in the body section 20 in such a manner that the respective ends of the stick type extension members 30 extend from the body section 20 in directions opposite to each other, a pair of shoulder sections 40 which each have elastically deformable long bodies, and a storage section embedded in the body section 20 in such a manner that each of the long bodies of the shoulder sections 40 can be housed from each side of the long bodies. The hanger body 10 has a plurality of locking means, which can be locked at the respective ends of the stick type extension members, on the other sides of the long bodies. In a state where the long bodies form the shoulder sections for clothing.

5 Claims, 9 Drawing Sheets

HANGER BODY FOR CLOTHING AND HANGER FURNISHED WITH THE HANGER BODY

This application is based on and claims the benefit of priority from Japanese Patent Application No. 2006-118576, filed on Apr. 21, 2006, the content of which is incorporated herein by reference.

BACKGROUND OF THE INVENTION

1. Field of the Invention

The present invention relates to a hanger body for clothing and a hanger furnished with the hanger body.

2. Related Art

Conventionally, this type of clothes hanger has been provided with a body section, a hook attached to the body section for hanging the body section on a pole or the like, and a pair of arched members provided at the body section and formed in a curved shape in such a manner that the respective ends of the pair of arched members extend from the body section in directions opposite each other. Clothes can be hung on the pair of arched members.

At the change of seasons, clothes suitable for the new season, or the prevailing fashion of the season, are hung on clothes hangers. Since a clothes hanger is recognized as a universal and finished daily commodity by consumers, it has a shape which is necessary only to fulfill the particular function of hanging clothes.

For example, a hanger described in the patent document 1 is formed in such a manner that the single hanger has a preferable width applicable for outerwear, jackets, and even a kimono (Japanese traditional clothing), which are of all sizes, and also the preferable width can be easily and quickly set without much effort, the preferable width once set being able to be securely stabilized. Furthermore, it is possible to optimize the effect of slip resistance so as to securely lock outerwear, such as a jacket and a business suit, once locked at the hanger, or to optimize the effect of locking trousers.

[Patent Document 1]

Japanese Unexamined Patent Application Publication No. 2002-330857

SUMMARY OF THE INVENTION

An object of the present invention is to provide a hanger body which can be used as an interior decoration when no hangers are required, and used as a hanger when needed.

In a first aspect of the present invention, the hanger body is used when clothes are hung out to dry, the hanger body comprising a body section, a pair of stick type extension members being extendable and telescopic, and embedded in the body section in such a manner that the respective ends of the pair of stick type extension members extend from the body section in directions opposite each other, a pair of shoulder sections having respective long bodies capable of elastic deformation, a storage section embedded in the body section in such a manner that each of the long bodies can be housed in the storage section from a first side of each long body, and locking means for locking at the respective ends of the stick type extension members, and provided at a second side of each long body. In a state where each of the stick type extension members extends from the body section and each of the long bodies extends from the storage section, the locking means are locked at the respective ends of the stick type extension members, and the long bodies form the shoulder sections for clothing.

The hanger body according to the present invention functions as a hanger, since clothes can be hung on the long bodies in a state where each of the stick type extension members extends from the body section and each of the long bodies extends from the storage section. Furthermore, since the pair of stick type extension members is embedded in the body section and the storage section is embedded in the body section, the stick type extension members and the long bodies can be housed in the body section when the hanger body is not being used as a hanger. Therefore, the body section can be used as an interior decoration by forming the body section into an elaborately designed shape.

In a second aspect of the hanger body for clothing as described in the first aspect, the body section is in a shape of a plate having substantially equal thickness, and the pair of stick type extension members is embedded in the body section in such a manner that the pair of stick type extension members can extend from opposing side surfaces of the body section in directions opposite each other, respectively.

In a third aspect of the hanger body for clothing as described in the second aspect, the respective long bodies of the pair of shoulder sections extend from opposing side surfaces of the body section which intersect a straight line lying at predetermined intervals and in parallel with the directions opposite each other. More specifically, the respective long bodies of the pair of the shoulder sections extend from opposing side surfaces of the body section which intersect a straight line lying, leaving a predetermined space in parallel with the pair of stick type extension members.

In a fourth aspect of the hanger body for clothing as described in any one of the first to third aspects, the storage section has a hoisting mechanism for hoisting the long bodies, and the hoisting mechanism applies a predetermined tensile force to a portion of the long body unwound from the hoisting mechanism. Accordingly, a tensile force is always applied to the long body on which clothes are hung, whereby shapes of the clothes can be properly maintained.

In a fifth aspect of the hanger body for clothing as described in the fourth aspect, the hoisting mechanism has a flat spiral spring which generates a restoring force when the long body is unwound to wind the long body, and the body section has a button for stopping and activating the hoisting mechanism. Accordingly, it is possible to activate the hoisting mechanism only when the long body is housed in the storage section.

In a sixth aspect of the hanger body for clothing as described in any one of the first to fifth aspects, the body section has a permanent magnet, which adheres to a magnetic member, on a first side surface of the body section. Accordingly, the hanger body can be directly attached to a magnetic pole such as an iron pole.

In a seventh aspect of the hanger body for clothing as described in the sixth aspect, a concave portion is formed on the first side surface described above, and the permanent magnet is provided at the concave portion. Accordingly, the pole described above is arranged on the concave portion, whereby it is possible to more securely attach the hanger body to a pole or the like.

In an eighth aspect of the hanger body for clothing as described in the seventh aspect, the body section has a second side surface, located on a side opposite to the first side surface described above, which has a shape such that the second side surface can be close to the first side surface, and the second side surface has a convex portion being substantially close to the concave portion. Accordingly, a hanger body equivalent to the hanger body according to the present invention can be continuously arranged so that the concave portion and the convex portion are coupled.

In a ninth aspect of the hanger body for clothing as described in the eighth aspect, the convex portion is formed of a magnetic. member. Accordingly, the convex portion and the concave portion are more securely combined by way of the permanent magnet provided at the concave portion.

In a tenth aspect of the hanger for clothing as described in any one of the first to sixth aspects, the body section has a second side surface, located on a side opposite to the first side surface, which has a shape such that the second side surface can be close to the first side surface.

In an eleventh aspect of the hanger for clothing as described in any one of the first to tenth aspects, the long body is selected from a ribbon, a string, and a tape. Each of the stick type extension members may be a rod or an antenna.

In a twelfth aspect of the hanger for clothing as described in any one of the first to twelfth aspects, the body section has an advertisement attachment section on which a surface thereof an advertisement can be displayed.

The hanger body for clothing described above can be used as a hanger by providing a hanger hook to be attached to the body section.

LEGEND

Figure 1:
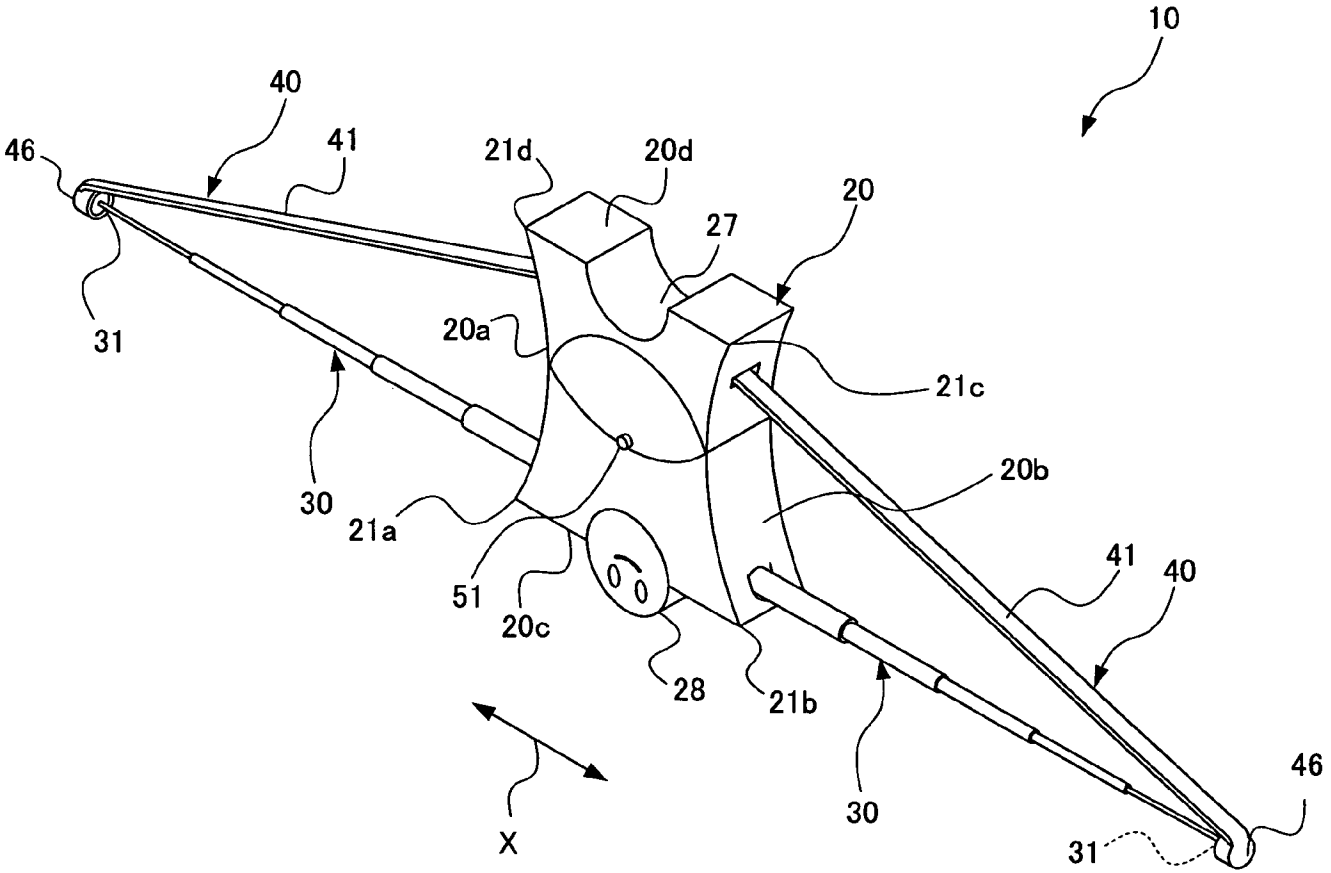
FIG. 1 is a perspective view illustrating an embodiment of the hanger body according to the present invention.

10: Hanger body
20: Body section
27: Concave portion
28: Convex portion
29: Advertisement attachment section
30: Stick type extension member
31: End
40: Shoulder section
41: Long body
45: Storage section
46: Locking means
50: Hoisting mechanism
60: Permanent magnet
80: Magnetic pole
81: Nonmagnetic pole
90: Hanger hook

DETAILED DESCRIPTION OF THE INVENTION

An embodiment of the present invention is described below with reference to accompanying drawings.

Figure 2:
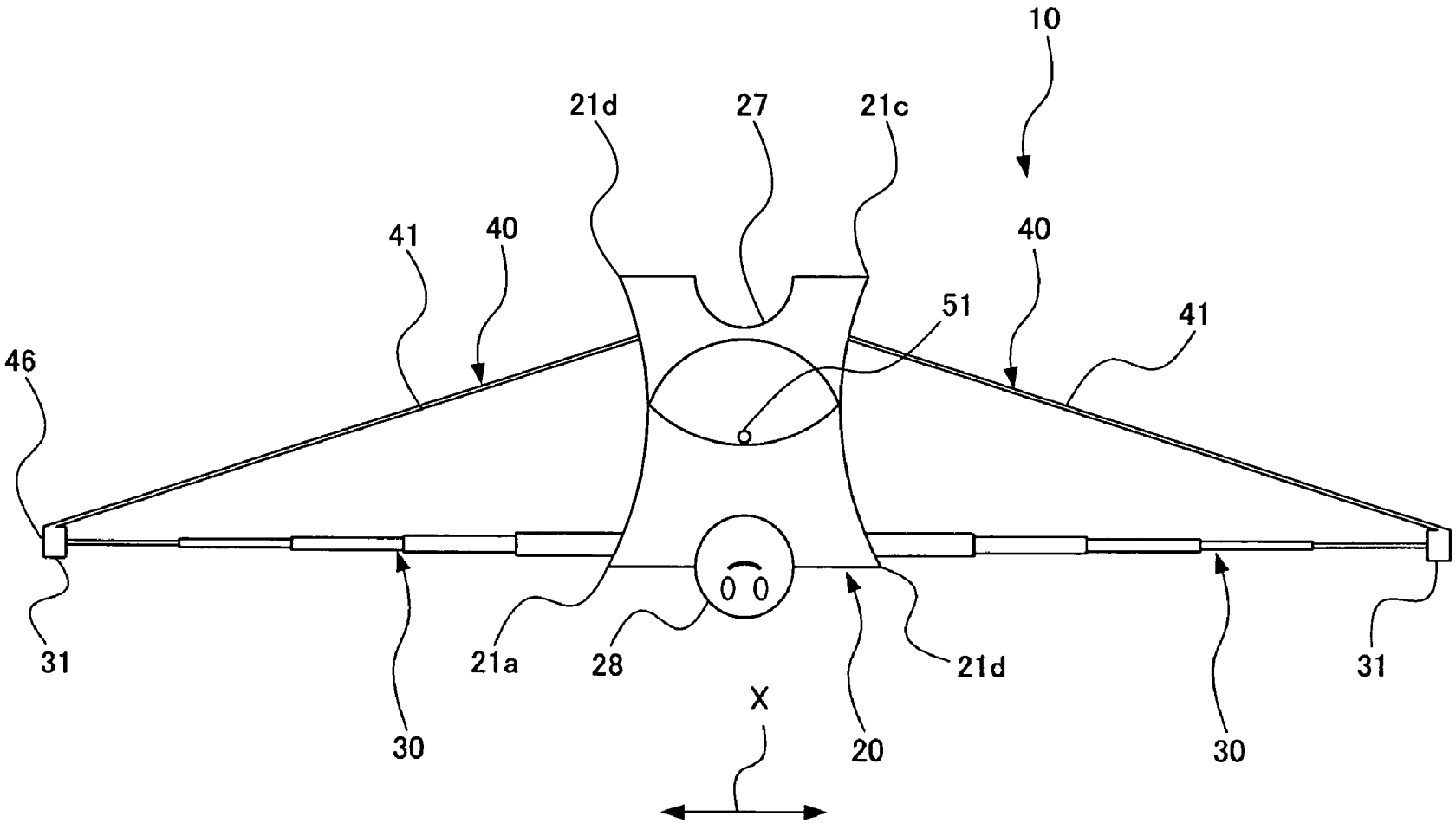
FIG. 2 is an elevation view of the hanger body shown in FIG. 1.

As shown in FIGS. 1 to 9, a hanger body 10 is used when clothes are hung out to dry. As shown in FIGS. 1 and 2, the hanger body 10 is provided with a body section 20, a pair of stick type extension members being extendable and telescopic 30, and a pair of shoulder sections 40. Rod antennas are used as an example of the stick type extension members 30.

Figure 3:
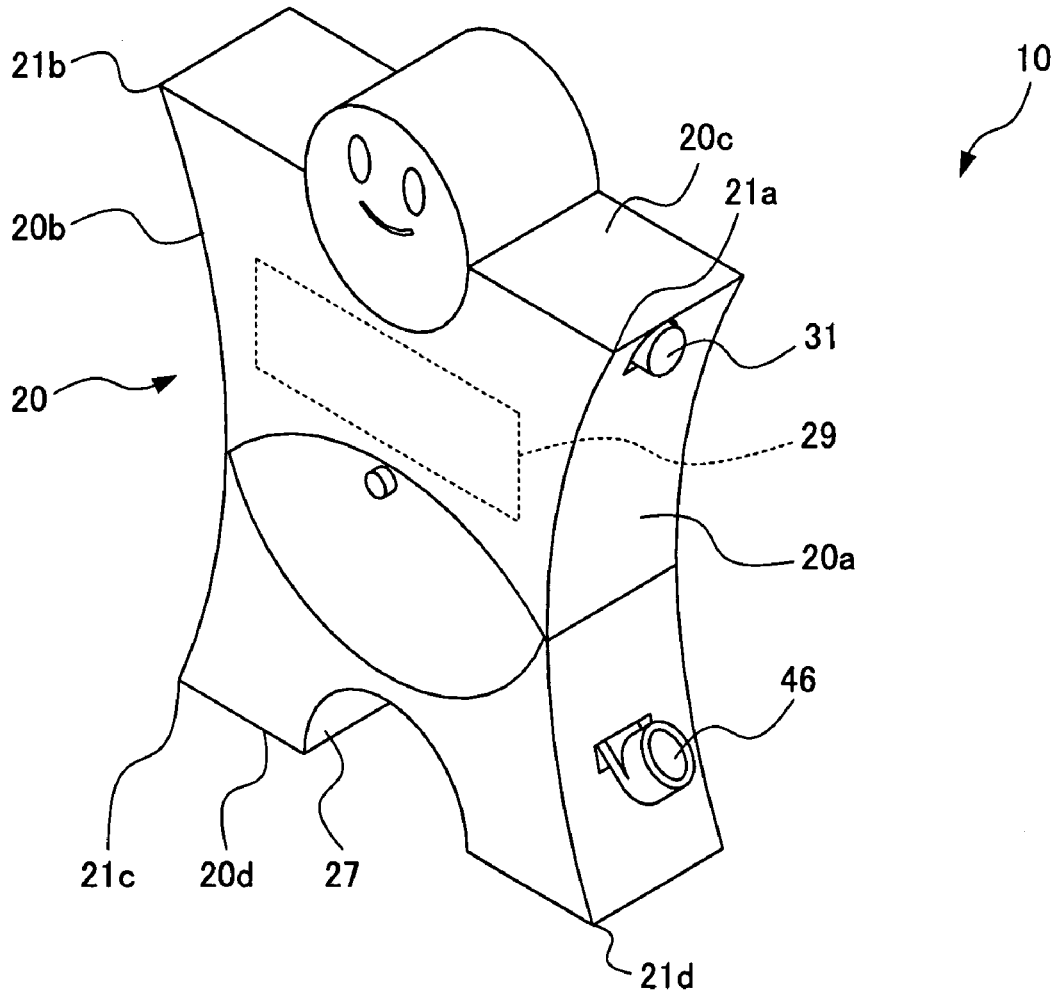
FIG. 3 is a perspective view illustrating a state where long bodies and stick type extension members of the hanger body shown in FIG. 1 are housed.
Figure 4:
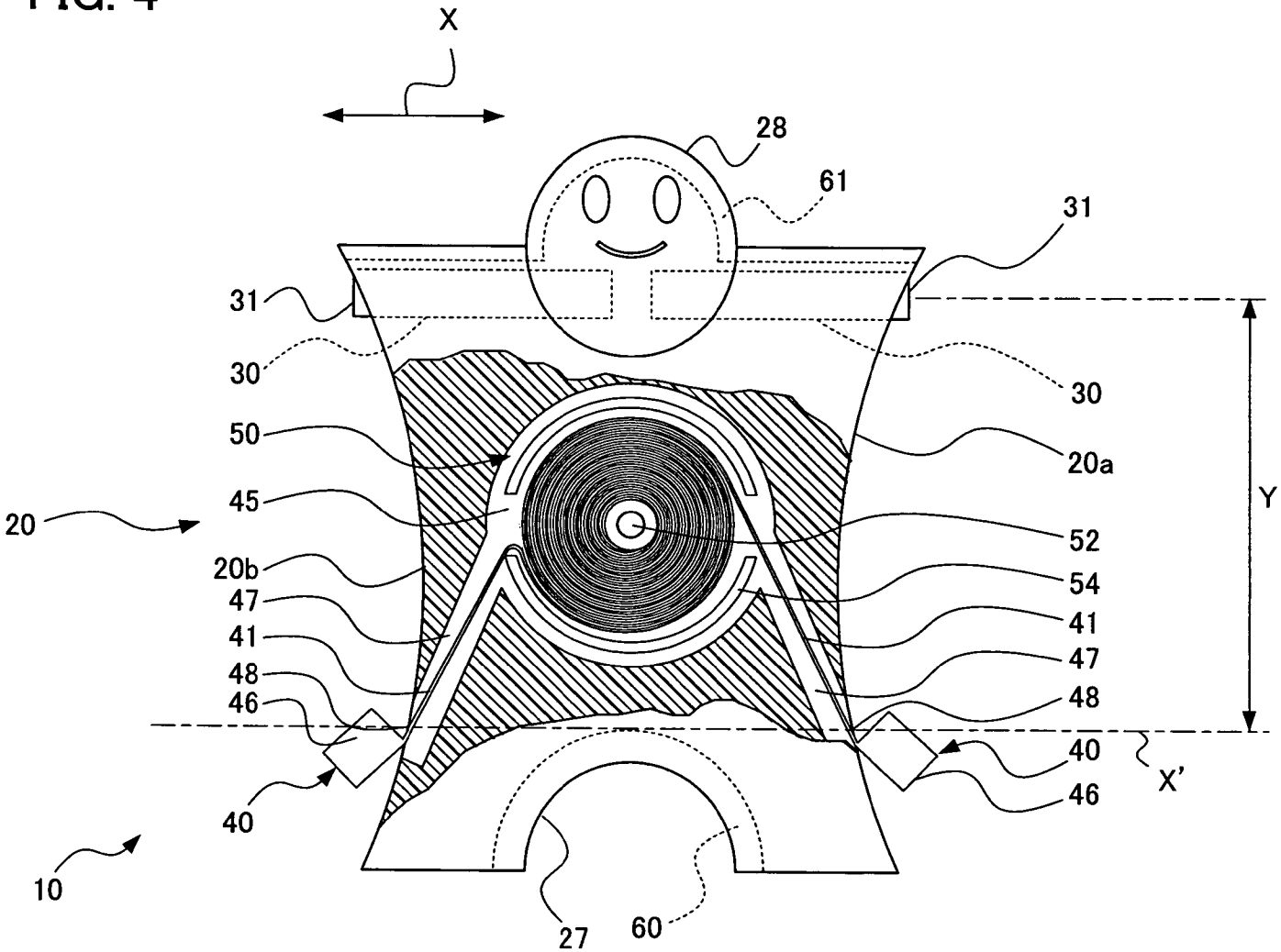
FIG. 4 is an elevation view of the hanger body shown in FIG. 3.
Figure 5:
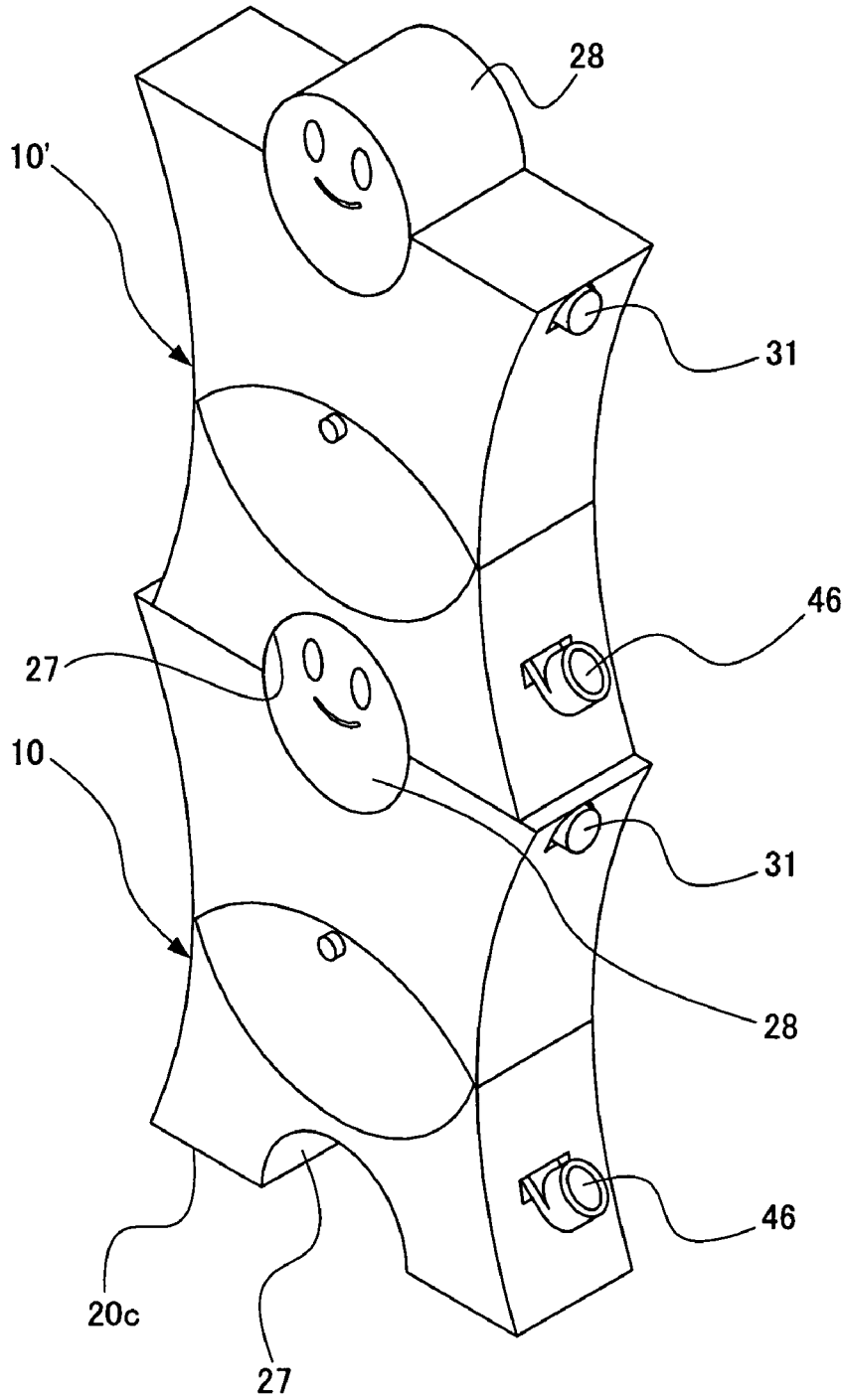
FIG. 5 is a perspective view showing a state where a plurality of hanger bodies shown in FIG. 3 is arranged stacked on each other.

As shown in FIGS. 3 and 4, the body section 20 is in a shape of a plate having a substantially equal thickness. The body section 20 is composed of four tops 21*a*, 21*b*, 21*c* and 21*d*, a concave portion 27, and a convex portion 28, which form the surroundings and form the flat surface of the body section 20 into a so-called shape of a doll. More specifically, the convex portion 28 represents the head of a doll, the concave portion 27 represents the crotch of a doll, the tops 21*a* and 21*b* represent the right and left hands of a doll, and the tops 21*c* and 21*d* represent the right and left legs of a doll. A design of a typical cute face is placed on at least one of the front side and back side of the convex portion 28. Therefore, the body section 20 forms a cute doll as a whole.

In this embodiment, a periphery of the body section 20 is formed by a side surface 20*a* between the top 21*a* and the top 21*d*, a side surface 20*b* between the top 21*b* and the top 21*c*, a side surface 20*c* between the top 21*a* and the top 21*b*, and a side surface 20*d* between the top 21*c* and the top 21*d*.

As shown in FIGS. 3 and 4, the body section 20 has a storage section 45 formed at substantially the center of the body section 20, a pair of openings 48 formed on one of the opposing side surfaces 20*a* and 20*b* of the body section 20, respectively, which intersects a straight line X' lying leaving a predetermined space Y in parallel with directions X opposite each other, and guiding channels 47 for connecting the respective storage sections 45 and openings 48. In other words, long bodies 41 of the pair of shoulder sections 40 extend from the side surface 20*a* and the side surface 20*b*, respectively, intersecting the straight line X', and providing the predetermined space Y from and in parallel with the pair of stick type extension members 30.

The pair of stick type extension members 30 is embedded in the body section 20 in such a manner that the stick type extension members 30 can extend from the respective opposing side surfaces 20*a* and 20*b* of the body section 20 in directions X opposite to each other. The stick type extension members 30 are embedded in the body section in such a manner that the respective ends 31 of the stick type extension members 30 extend from the body section 20 in directions X opposite to each other. Therefore, as shown in FIGS. 3 and 4, in a state where the pair of stick type extension members 30 is housed, almost all portions of the pair of the stick type extension members 30 are housed inside the body section 20.

The stick type extension members 30 have a plurality of pipes of different diameters, the cylindrical ends 31 formed at a tip thereof having the smallest diameter. As shown in FIG. 1, when the stick type extension member 30 extends, each of the plurality of pipes slide and adjacent pipes overlap each other at the tips.

As shown in FIGS. 1, 2, and 4, each of the shoulder sections 40 has the long bodies 41 capable of elastic deformation. In addition, the hanger body 10 has the storage section 45 embedded in the body section 20 in such a manner that the long body 41 can be housed in the storage section 45 from a first side of the long body 41 and the locking means 46 for locking at the respective ends 31 of the stick type extension members 30 on a second side of the respective long bodies 41.

The locking means 46 are formed on the second side of the respective long bodies 41. The locking means 46 may be formed at the respective ends 31 of the stick type extension members 30.

Each of the locking means 46 has a cylindrical outer shape, and a concave portion, in which the end 31 of the stick type extension member 30 can be fitted, is formed at the respective centers of the locking means 46. If the end 31 of the stick type extension member 30 and the second side of the long body 41 do not disengage from each other, an adhesive which can be easily attached or removed, or a fastener composed of a plurality of support media furnished with a plurality of hooks and a plurality of loops, may be used. It is preferable to use a ribbon, string, or tape as the long body 41.

As shown in FIG. 4, a hoisting axis 52 for hoisting the long bodies 41 from the second side of the long bodies 41 is provided at the storage section 45 in such a manner that the hoisting axis 52 can be easily rotated. The long bodies 41 of the pair of shoulder sections 40 are hoisted on to the hoisting axis 52 provided at the storage section 45 from the pair of openings 48 via the guiding channels 47, respectively. Furthermore, one long body 41 is wound on the hoisting axis 52 provided inside the body section 20, and the other long body 41 is wound on the hoisting axis 52 in the same direction after sliding over a guide 54. Therefore, if one long body 41 is pulled out, the other long body 41 will be unwound simultaneously.

A hoisting mechanism 50 has a flat spiral spring generates a restoring force when the long body 41 is unwound in order to wind the long body 41, and the body section 20 has a button 51 for stopping and activating the hoisting mechanism 50. The button 51 is provided on an axis line of the hoisting axis 52. When the button 51 is depressed, the restoring force of the flat spiral spring arranged under the button 51 is released. Accordingly, the pair of long bodies 41 is hoisted onto the hoisting axis 52 due to hoisting force of the flat spiral spring. Therefore, if a user depresses the button 51, the pair of long bodies 41 is retracted into the storage section 45.

More specifically, as shown in FIG. 2, in order to use the hanger body 10 as a hanger, at first, the stick type extension members 30 are extended from the body section 20, then the long bodies 41 are drawn out of the storage section 45 via the guiding channels 47 and the openings 48 formed on the side surfaces 20*a* and 20*b*, followed by the locking means 46 being locked at the ends 31.

Accordingly, the shoulder sections 40 form a short isosceles triangle, which is a general shape of a hanger, whereby the hanger body 10 can be used as a hanger.

The storage section 45 has the hoisting mechanism 50 for hoisting the pair of long bodies 41. The hoisting mechanism 50 winds the pair of long bodies on the common hoisting axis 52 in the same direction, whereby if one long body 41 is drawn out, the other long body 41 is drawn out as well.

The hoisting mechanism 50 is arranged such that a predetermined tensile force is applied to a portion of the long body 41 unwound from the hoisting mechanism 50. Accordingly, as shown in FIG. 2, a tensile force is always applied to the long bodies 41 on which clothes are hung, whereby the shapes of clothes are properly maintained.

Figure 6:
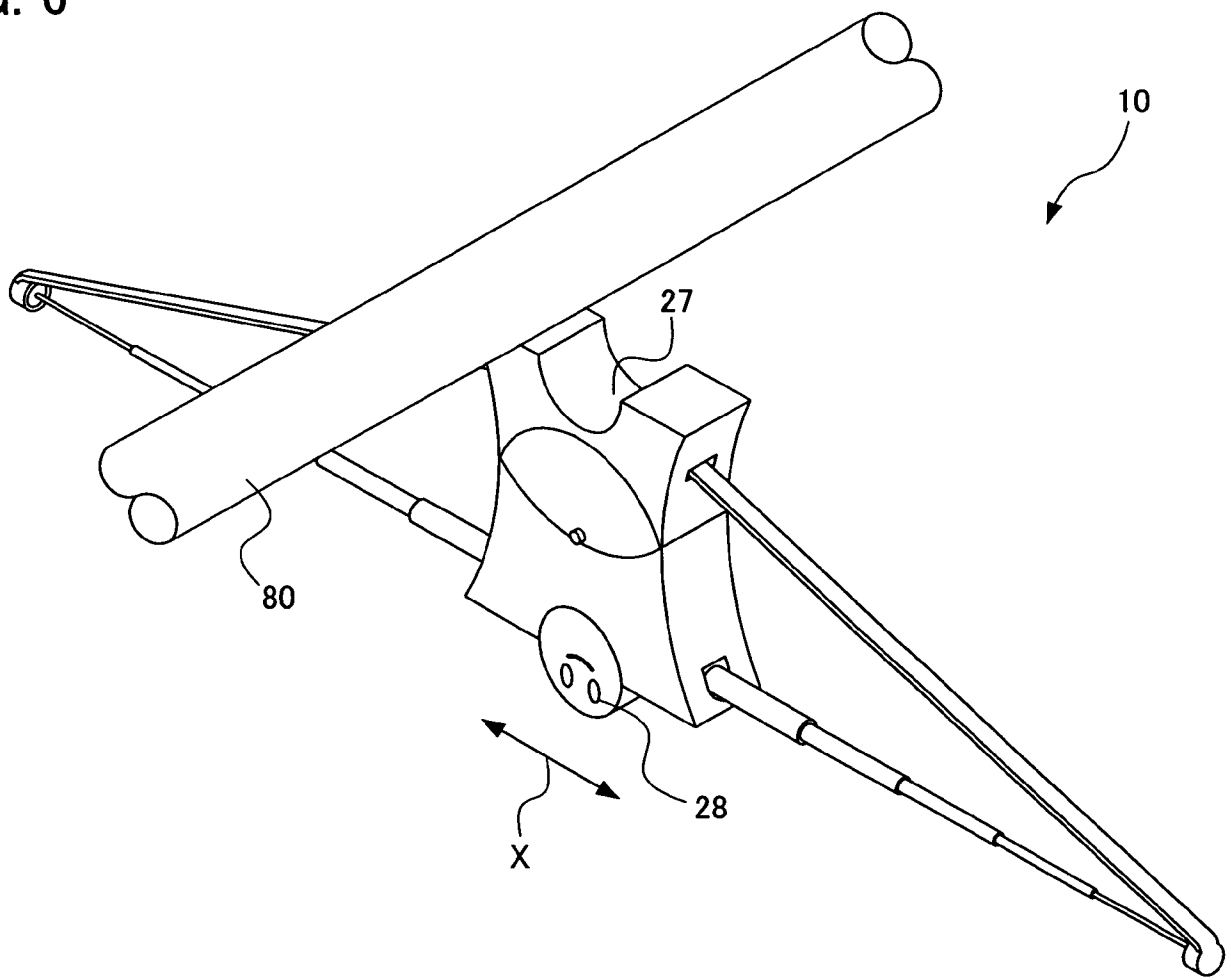
FIG. 6 is a perspective view illustrating a state where the hanger body shown in FIG. 1 is attached to a magnetic pole.
Figure 7:
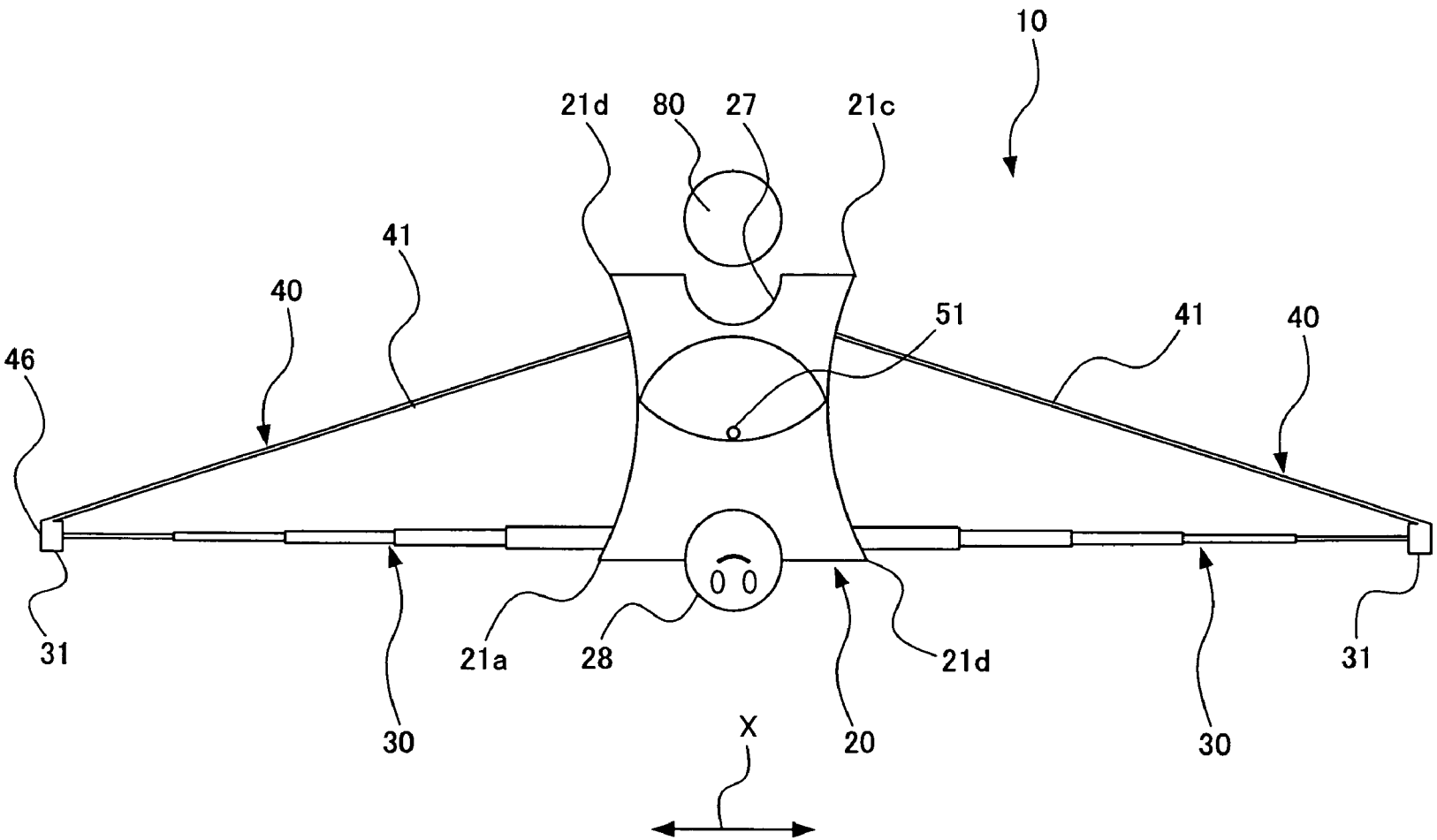
FIG. 7 is an elevation view of the hanger body shown in FIG. 6.

The body section 20 has a permanent magnet 60, which adheres to a magnetic member, at the semicylindrical concave portion 27 formed on a first side surface 20*c*. As shown in FIGS. 6 and 7, the permanent magnet 60 adheres to a magnetic pole 80, such as an iron pole, and the pole 80 is arranged at the concave portion 27, whereby the hanger body 10 can be directly attached to the pole 80.

The body section 20 has the second side surface 20*d*, located on a side opposite t the first side surface 20*c*, which has a shape such that the second side surface 20*d* can be close to the first side surface 20*c*, and the second side surface 20*d* has the convex portion 28 being substantially close to the concave portion 27. Accordingly, a hanger body 10', equivalent to the hanger body 10 according to the present invention, can be continuously arranged so that a concave portion 27 of the hanger body 10' and the convex portion 28 of the hanger body 10 are coupled. From this, incentive for collection by collectors is provided.

Since the convex portion 28 of the hanger body 10 is formed of a magnetic member 61, such as an iron member, the convex portion 28 of the hanger body 10 is more securely adhered with the concave portion 27 of the hanger body 10' due to the permanent magnet 60 attached to the concave portion 27 of the hanger body 10'.

The body section 20 has the second side surface 20*d*, located on a side opposite of the first side surface 20*c*, which has a shape such that the second side surface 20*d* can be close to the first side surface 20*c*.

The body section 20 may have an advertisement attachment section 29 on which an advertisement can be displayed on the surface, as shown in FIG. 3.

Figure 8:
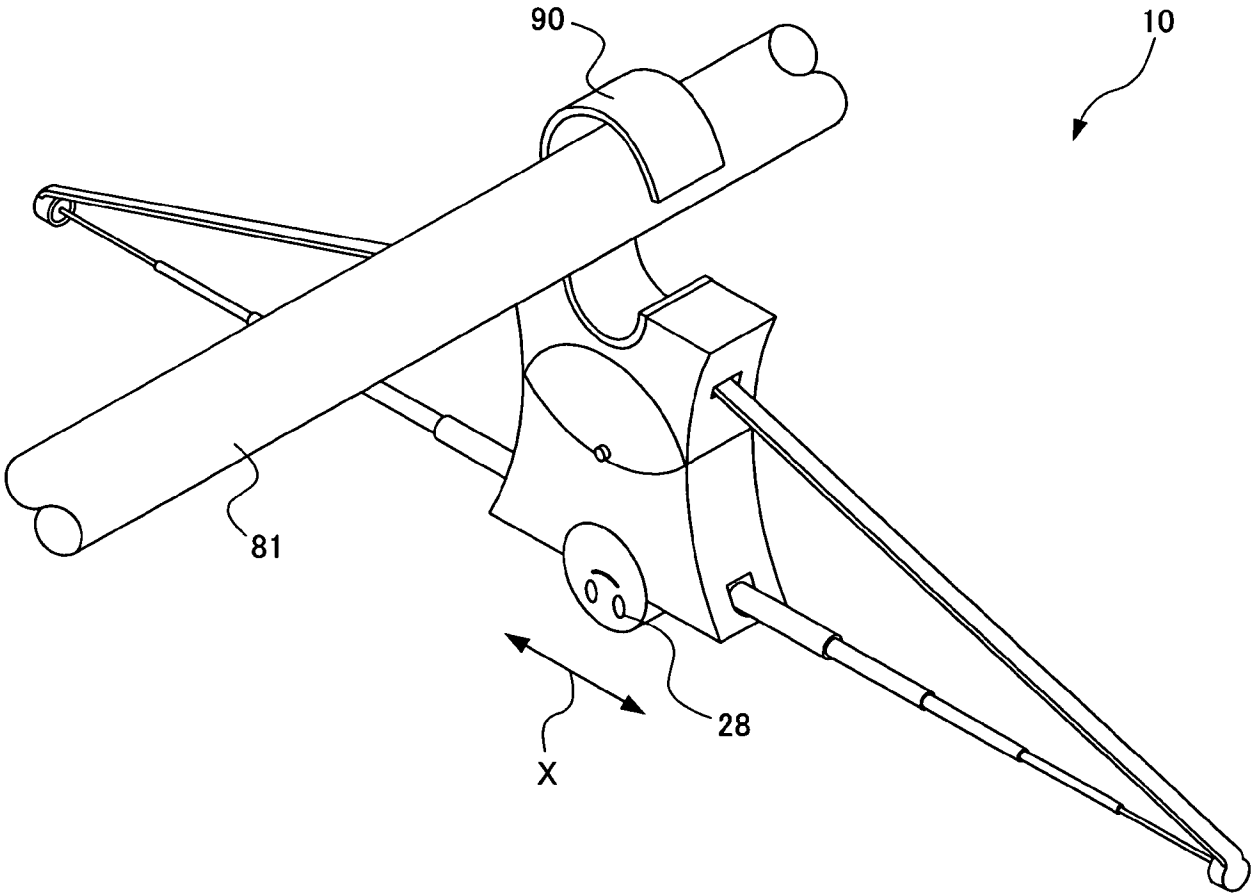
FIG. 8 is a perspective view illustrating a state where the hanger body shown in FIG. 1 is attached to a nonmagnetic pole.
Figure 9:
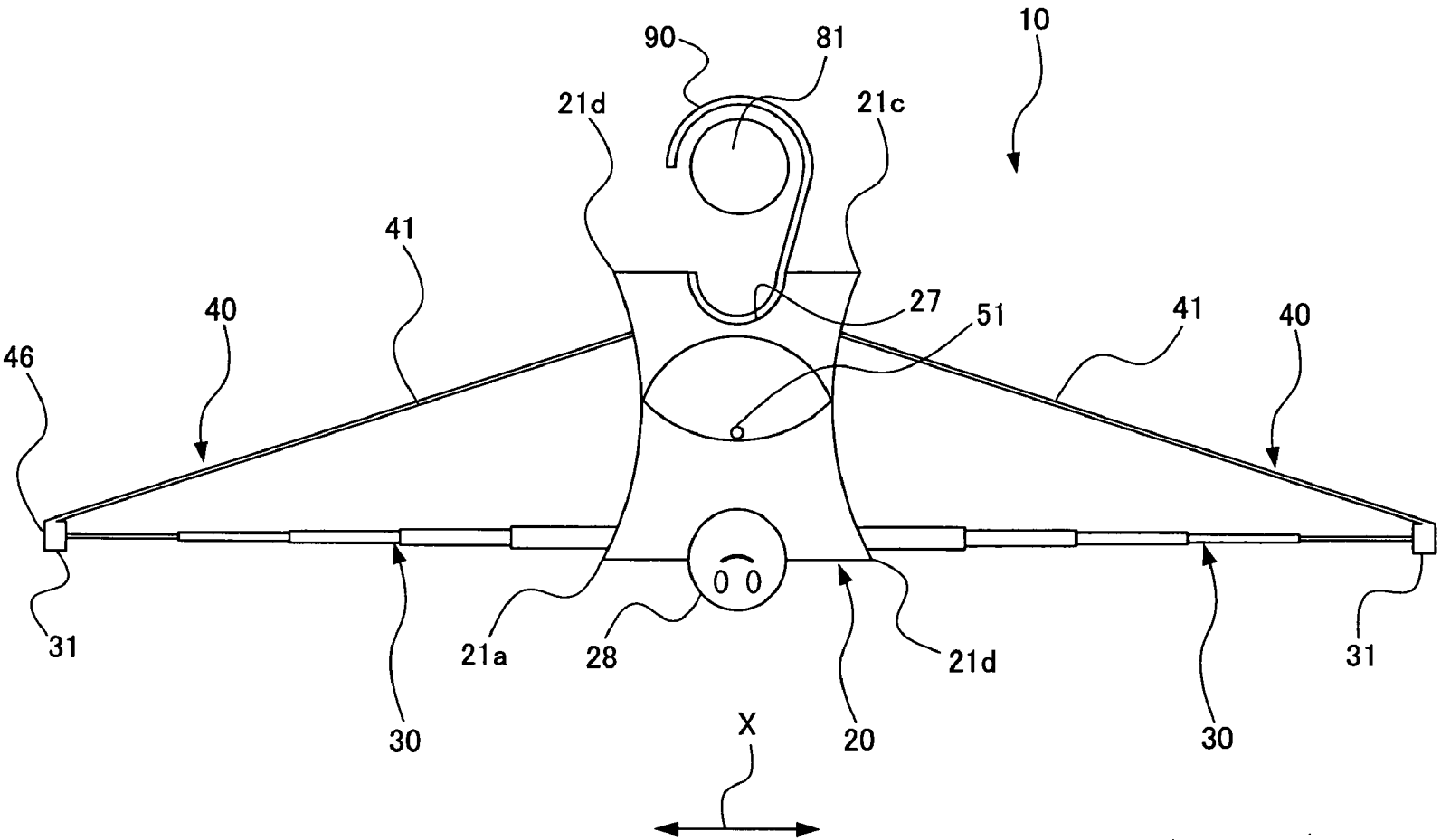
FIG. 9 is an elevation view of the hanger body shown in FIG. 6.

As shown in FIGS. 8 and 9, the hanger body 10 described above can be used with a nonmagnetic pole 81, such as a wooden pole, by providing a magnetic hanger hook 90, such as an iron hook. The magnetic force of the permanent magnet 60 provided on the concave portion 27 enables the hanger hook 90 to adhere to the concave portion 27.

The hanger body 10 described above functions as a hanger by forming a state where the stick type extension members 30 extend from the body section 20, the long bodies 41 extend from the storage section 45, and further, by locking the locking means at the respective ends 31 of the stick type extension members 30. In addition, by housing the stick type extension members 30 and the long bodies 41 in the body section 20 and the storage section 45, respectively, an outward appearance of the hanger body 10 is substantially the same as that of the body section 20, and does not substantially resemble a hanger, whereby the hanger body 10 can be used as an accessory.

More specifically, the hanger body 10 functions as a hanger since clothes can be hung on the long bodies 41 in a state where the stick type extension members 30 extend from the body section 20 and the long bodies 41 extend from the storage section 45. Furthermore, since the pair of stick type extension members 30 is embedded in the body section 20 and the storage section 45 is embedded in the body section 20, the stick type extension members 30 and the long bodies 41 can be housed in the body section 20 when the hanger body 10 is not used as a hanger. Therefore, the body section 20 can be used as an interior decoration by forming the body section 20 into an elaborately designed shape.

In addition, when the hanger body 10 is not used as a hanger, the long bodies 41 are housed in the storage section 45 by depressing the button 51 provided on a surface of the body section 20. Furthermore, the stick type extension members 30 are housed inside the body section 20. Therefore, an outward appearance of the hanger body 10 becomes substantially the same as that of the body section 20, and becomes compact. As described above, the outward appearance of the body section 20 has a shape of a cute doll, whereby the body section can be used as an interior decoration.

Furthermore, since the hanger body 10 can be vertically stacked on another hanger body equivalent to the hanger body 10, various arrangements can be made. Moreover, an arrangement of many hanger bodies 10 of different colors provides collection incentive for collectors.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A hanger body for clothing to be used when clothes are hung out to dry, said hanger body comprising:

a body section;

a pair of stick type extension members extendable and telescopic, and embedded in said body section in such a manner that the respective ends of said stick type extension members extend from said body section in directions opposite to each other;

a pair of shoulder sections having respective long bodies capable of elastic deformation;

a storage section embedded in said body section in such a manner that each of said long bodies of said shoulder sections can be housed from each first side of said long bodies; and a locking mechanism for locking at said respective ends of said stick type extension members, and disposed at each second side of said long bodies, wherein in a state that said respective stick type extension members extend from said body section and said respective long bodies extend from said storage section, said locking mechanism are locked at said respective ends of said stick type extension members, and said long bodies form said shoulder sections for clothing;

said body section is in a shape of a plate having substantially equal thickness, and said pair of stick type extension members is embedded in said body section in such a manner that said pair of stick type extension members can extend from opposing side surfaces of said body section in directions opposite to each other, respectively; and said long bodies of said pair of shoulder sections extend from each opposing side surfaces of said body section, and said long bodies of said pair of shoulder section intersect a straight line which is parallel to extension directions of said pair of stick type extension members and which is apart from said extension directions by a predetermined interval.

2. A hanger body for clothing to be used when clothes are hung out to dry, said hanger body comprising:

a body section;

a pair of stick type extension members extendable and telescopic, and embedded in said body section in such a manner that the respective ends of said stick type extension members extend from said body section in directions opposite to each other;

a pair of shoulder sections having respective long bodies capable of elastic deformation;

a storage section embedded in said body section in such a manner that each of said long bodies of said shoulder sections can be housed from each first side of said long bodies; and a locking mechanism for locking at said respective ends of said stick type extension members, and disposed at each second side of said long bodies, wherein in a state that said respective stick type extension members extend from said body section and said respective long bodies extend from said storage section, said locking mechanism are locked at said respective ends of said stick type extension members, and said long bodies form said shoulder sections for clothing; and said body section has a permanent magnet, which adheres to a magnetic member, on a first side surface of said body section.

3. The hanger body for clothing according to claim 2, wherein a concave portion is formed on said first side surface, and said permanent magnet is provided at said concave portion.

4. The hanger body for clothing according to claim 3, wherein said body section has a second side surface, located on a side opposite to said first side surface, which has a shape such that said second side surface can be close to said first side surface, and said second side surface has a convex portion being substantially close to said concave portion.

5. The hanger body for clothing according to claim 4, wherein said convex portion is formed of a magnetic member.

* * * * *